US007571906B2

(12) United States Patent
Dyer et al.

(10) Patent No.: US 7,571,906 B2
(45) Date of Patent: Aug. 11, 2009

(54) SHEET FEED MECHANISM

(75) Inventors: Geoffrey Philip Dyer, Balmain (AU); Robert John Brice, Balmain (AU); Attila Bertok, Balmain (AU); Gregory Michael Tow, Balmain (AU); Tobin Allen King, Balmain (AU); Kia Silverbrook, Balmain (AU)

(73) Assignee: Silverbrook Research Pty Ltd, Balmain, New South Wales (AU)

( * ) Notice: Subject to any disclaimer, the term of this patent is extended or adjusted under 35 U.S.C. 154(b) by 384 days.

(21) Appl. No.: 11/482,981

(22) Filed: Jul. 10, 2006

(65) Prior Publication Data

US 2008/0006986 A1 Jan. 10, 2008

(51) Int. Cl.
*B65H 1/26* (2006.01)

(52) U.S. Cl. ..... 271/157; 271/160

(58) Field of Classification Search ..... 271/157, 271/160, 147

See application file for complete search history.

(56) References Cited

U.S. PATENT DOCUMENTS 4,418,903 A 12/1983 Landa
6,315,282 B2 * 11/2001 Chua et al. ..... 271/121
6,485,014 B1 11/2002 Lin
6,485,015 B2 * 11/2002 Yen et al. ..... 271/121
6,499,736 B2 * 12/2002 Hsieh ..... 271/147
6,953,190 B2 * 10/2005 Shin ..... 271/170
2003/0193128 A1 10/2003 Takai
2004/0041329 A1 3/2004 Hiraoka

FOREIGN PATENT DOCUMENTS

EP 0246703 B1 11/1987

* cited by examiner

*Primary Examiner*—Patrick H Mackey
*Assistant Examiner*—Michael C McCullough

(57) ABSTRACT

A sheet feed mechanism for a device such as a printer, with a chassis 2 configured to support a stack of sheets 4. A top sheet engaging member 6 for engaging the top-most sheet 40 of the stack and moving it relative to the remainder of the stack 4. A stack engaging structure 8 for engaging the stack 4 and biasing its top sheet 40 against the top sheet engaging member 6. The stack engaging structure 8 having a friction surface 18 extending parallel to the stack engaging structure's direction of travel. A lock mechanism 12 mounted to the chassis 2 for limited relative movement thereto, the lock mechanism 12 having a biased contact foot 32 for engaging the friction surface 18 to secure the stack engaging structure 8 to the lock mechanism 12 for movement therewith. An actuator 20 mounted to the chassis 2 to disengage the contact foot 32 from the friction surface such that the stack engaging structure 8 moves relative to the lock mechanism 12 to press the top-most sheet 40 against the top sheet engaging 6, then the actuator disengages the contact foot 32 such that it re-engages the friction surface 18 and then moves the lock mechanism relative to the chassis 2 such that the stack engaging structure 8 also retracts a predetermined distance from the top-most sheet engaging member 6.

10 Claims, 16 Drawing Sheets

SHEET FEED MECHANISM

FIELD OF THE INVENTION

The present invention relates to a mechanism for moving a stack of sheet material. In particular, the invention is a mechanism for lifting a stack of sheet media for feeding individual sheets into a feed path.

CO-PENDING APPLICATIONS

The following applications have been filed by the Applicant simultaneously with the present application:

| | | | | |
|---|---|---|---|---|
| 11/482,975 | 11/482,970 | 11/482,968 | 11/482,972 | 11/482,971 |
| 11/482,969 | 11/482,958 | 11/482,955 | 11/482,962 | 11/482,963 |

-continued

| | | | | |
|---|---|---|---|---|
| 11/482,956 | 11/482,954 | 11/482,974 | 11/482,957 | 11/482,987 |
| 11/482,959 | 11/482,960 | 11/482,961 | 11/482,964 | 11/482,965 |
| 11/482,976 | 11/482,982 | 11/482,983 | 11/482,984 | 11/482,979 |
| 11/482,990 | 11/482,986 | 11/482,985 | 11/482,978 | 11/482,967 |
| 11/482,966 | 11/482,988 | 11/482,989 | 11/482,980 | 11/482,981 |
| 11/482,953 | 11/482,977 | | | |

The disclosures of these co-pending applications are incorporated herein by reference.

CROSS REFERENCES TO RELATED APPLICATIONS

Various methods, systems and apparatus relating to the present invention are disclosed in the following U.S. Patents/patent applications filed by the applicant or assignee of the present invention:

| | | | | | | |
|---|---|---|---|---|---|---|
| 09/517,539 | 6,566,858 | 6,331,946 | 6,246,970 | 6,442,525 | 09/517,384 | 09/505,951 |
| 6,374,354 | 09/517,608 | 6,816,968 | 6,757,832 | 6,334,190 | 6,745,331 | 09/517,541 |
| 10/203,559 | 10/203,560 | 10/203,564 | 10/636,263 | 10/636,283 | 10/866,608 | 10/902,889 |
| 10/902,833 | 10/940,653 | 10/942,858 | 10/727,181 | 10/727,162 | 10/727,163 | 10/727,245 |
| 10/727,204 | 10/727,233 | 10/727,280 | 10/727,157 | 10/727,178 | 10/727,210 | 10/727,257 |
| 10/727,238 | 10/727,251 | 10/727,159 | 10/727,180 | 10/727,179 | 10/727,192 | 10/727,274 |
| 10/727,164 | 10/727,161 | 10/727,198 | 10/727,158 | 10/754,536 | 10/754,938 | 10/727,227 |
| 10/727,160 | 10/934,720 | 11/212,702 | 11/272,491 | 10/296,522 | 6,795,215 | 10/296,535 |
| 09/575,109 | 6,805,419 | 6,859,289 | 6,977,751 | 6,398,332 | 6,394,573 | 6,622,923 |
| 6,747,760 | 6,921,144 | 10/884,881 | 10/943,941 | 10/949,294 | 11/039,866 | 11/123,011 |
| 6,986,560 | 7,008,033 | 11/148,237 | 11/248,435 | 11/248,426 | 10/922,846 | 10/922,845 |
| 10/854,521 | 10/854,522 | 10/854,488 | 10/854,487 | 10/854,503 | 10/854,504 | 10/854,509 |
| 10/854,510 | 10/854,496 | 10/854,497 | 10/854,495 | 10/854,498 | 10/854,511 | 10/854,512 |
| 10/854,525 | 10/854,526 | 10/854,516 | 10/854,508 | 10/854,507 | 10/854,515 | 10/854,506 |
| 10/854,505 | 10/854,493 | 10/854,494 | 10/854,489 | 10/854,490 | 10/854,492 | 10/854,491 |
| 10/854,528 | 10/854,523 | 10/854,527 | 10/854,524 | 10/854,520 | 10/854,514 | 10/854,519 |
| 10/854,513 | 10/854,499 | 10/854,501 | 10/854,500 | 10/854,502 | 10/854,518 | 10/854,517 |
| 10/934,628 | 11/212,823 | 10/728,804 | 10/728,952 | 10/728,806 | 6,991,322 | 10/728,790 |
| 10/728,884 | 10/728,970 | 10/728,784 | 10/728,783 | 10/728,925 | 6,962,402 | 10/728,803 |
| 10/728,780 | 10/728,779 | 10/773,189 | 10/773,204 | 10/773,198 | 10/773,199 | 6,830,318 |
| 10/773,201 | 10/773,191 | 10/773,183 | 10/773,195 | 10/773,196 | 10/773,186 | 10/773,200 |
| 10/773,185 | 10/773,192 | 10/773,197 | 10/773,203 | 10/773,187 | 10/773,202 | 10/773,188 |
| 10/773,194 | 10/773,193 | 10/773,184 | 11/008,118 | 11/060,751 | 11/060,805 | 11/188,017 |
| 11/298,773 | 11/298,774 | 11/329,157 | 6,623,101 | 6,406,129 | 6,505,916 | 6,457,809 |
| 6,550,895 | 6,457,812 | 10/296,434 | 6,428,133 | 6,746,105 | 10/407,212 | 10/407,207 |
| 10/683,064 | 10/683,041 | 6,750,901 | 6,476,863 | 6,788,336 | 11/097,308 | 11/097,309 |
| 11/097,335 | 11/097,299 | 11/097,310 | 11/097,213 | 11/210,687 | 11/097,212 | 11/212,637 |
| 11/246,687 | 11/246,718 | 11/246,685 | 11/246,686 | 11/246,703 | 11/246,691 | 11/246,711 |
| 11/246,690 | 11/246,712 | 11/246,717 | 11/246,709 | 11/246,700 | 11/246,701 | 11/246,702 |
| 11/246,668 | 11/246,697 | 11/246,698 | 11/246,699 | 11/246,675 | 11/246,674 | 11/246,667 |
| 11/246,684 | 11/246,672 | 11/246,673 | 11/246,683 | 11/246,682 | 10/760,272 | 10/760,273 |
| 10/760,187 | 10/760,182 | 10/760,188 | 10/760,218 | 10/760,217 | 10/760,216 | 10/760,233 |
| 10/760,246 | 10/760,212 | 10/760,243 | 10/760,201 | 10/760,185 | 10/760,253 | 10/760,255 |
| 10/760,209 | 10/760,208 | 10/760,194 | 10/760,238 | 10/760,234 | 10/760,235 | 10/760,183 |
| 10/760,189 | 10/760,262 | 10/760,232 | 10/760,231 | 10/760,200 | 10/760,190 | 10/760,191 |
| 10/760,227 | 10/760,207 | 10/760,181 | 10/815,625 | 10/815,624 | 10/815,628 | 10/913,375 |
| 10/913,373 | 10/913,374 | 10/913,372 | 10/913,377 | 10/913,378 | 10/913,380 | 10/913,379 |
| 10/913,376 | 10/913,381 | 10/986,402 | 11/172,816 | 11/172,815 | 11/172,814 | 11/003,786 |
| 11/003,616 | 11/003,418 | 11/003,334 | 11/003,600 | 11/003,404 | 11/003,419 | 11/003,700 |
| 11/003,601 | 11/003,618 | 11/003,615 | 11/003,337 | 11/003,698 | 11/003,420 | 6,984,017 |
| 11/003,699 | 11/071,473 | 11/003,463 | 11/003,701 | 11/003,683 | 11/003,614 | 11/003,702 |
| 11/003,684 | 11/003,619 | 11/003,617 | 11/293,800 | 11/293,802 | 11/293,801 | 11/293,808 |
| 11/293,809 | 11/246,676 | 11/246,677 | 11/246,678 | 11/246,679 | 11/246,680 | 11/246,681 |
| 11/246,714 | 11/246,713 | 11/246,689 | 11/246,671 | 11/246,670 | 11/246,669 | 11/246,704 |
| 11/246,710 | 11/246,688 | 11/246,716 | 11/246,715 | 11/246,707 | 11/246,706 | 11/246,705 |
| 11/246,708 | 11/246,693 | 11/246,692 | 11/246,696 | 11/246,695 | 11/246,694 | 11/293,832 |
| 11/293,838 | 11/293,825 | 11/293,841 | 11/293,799 | 11/293,796 | 11/293,797 | 11/293,798 |
| 10/760,254 | 10/760,210 | 10/760,202 | 10/760,197 | 10/760,198 | 10/760,249 | 10/760,263 |
| 10/760,196 | 10/760,247 | 10/760,223 | 10/760,264 | 10/760,244 | 10/760,245 | 10/760,222 |
| 10/760,248 | 10/760,236 | 10/760,192 | 10/760,203 | 10/760,204 | 10/760,205 | 10/760,206 |
| 10/760,267 | 10/760,270 | 10/760,259 | 10/760,271 | 10/760,275 | 10/760,274 | 10/760,268 |
| 10/760,184 | 10/760,195 | 10/760,186 | 10/760,261 | 10/760,258 | 11/293,804 | 11/293,840 |
| 11/293,803 | 11/293,833 | 11/293,834 | 11/293,835 | 11/293,836 | 11/293,837 | 11/293,792 |
| 11/293,794 | 11/293,839 | 11/293,826 | 11/293,829 | 11/293,830 | 11/293,827 | 11/293,828 |
| 11/293,795 | 11/293,823 | 11/293,824 | 11/293,831 | 11/293,815 | 11/293,819 | 11/293,818 |

-continued

| | | | | | | |
|---|---|---|---|---|---|---|
| 11/293,817 | 11/293,816 | 11/014,764 | 11/014,763 | 11/014,748 | 11/014,747 | 11/014,761 |
| 11/014,760 | 11/014,757 | 11/014,714 | 11/014,713 | 11/014,762 | 11/014,724 | 11/014,723 |
| 11/014,756 | 11/014,736 | 11/014,759 | 11/014,758 | 11/014,725 | 11/014,739 | 11/014,738 |
| 11/014,737 | 11/014,726 | 11/014,745 | 11/014,712 | 11/014,715 | 11/014,751 | 11/014,735 |
| 11/014,734 | 11/014,719 | 11/014,750 | 11/014,749 | 11/014,746 | 11/014,769 | 11/014,729 |
| 11/014,743 | 11/014,733 | 11/014,754 | 11/014,755 | 11/014,765 | 11/014,766 | 11/014,740 |
| 11/014,720 | 11/014,753 | 11/014,752 | 11/014,744 | 11/014,741 | 11/014,768 | 11/014,767 |
| 11/014,718 | 11/014,717 | 11/014,716 | 11/014,732 | 11/014,742 | 11/097,268 | 11/097,185 |
| 11/097,184 | 11/293,820 | 11/293,813 | 11/293,822 | 11/293,812 | 11/293,821 | 11/293,814 |
| 11/293,793 | 11/293,842 | 11/293,811 | 11/293,807 | 11/293,806 | 11/293,805 | 11/293,810 |
| 09/575,197 | 09/575,195 | 09/575,159 | 09/575,123 | 6,825,945 | 09/575,165 | 6,813,039 |
| 6,987,506 | 09/575,131 | 6,980,318 | 6,816,274 | 09/575,139 | 09/575,186 | 6,681,045 |
| 6,728,000 | 09/575,145 | 09/575,192 | 09/575,181 | 09/575,193 | 09/575,183 | 6,789,194 |
| 6,789,191 | 6,644,642 | 6,502,614 | 6,622,999 | 6,669,385 | 6,549,935 | 09/575,187 |
| 6,727,996 | 6,591,884 | 6,439,706 | 6,760,119 | 09/575,198 | 6,290,349 | 6,428,155 |
| 6,785,016 | 09/575,174 | 09/575,163 | 6,737,591 | 09/575,154 | 09/575,129 | 6,830,196 |
| 6,832,717 | 6,957,768 | 09/575,162 | 09/575,172 | 09/575,170 | 09/575,171 | 09/575,161 |

The disclosures of these applications and patents are incorporated herein by reference.

BACKGROUND OF THE INVENTION

Sheet material is typically supplied and stored in stacks. To use the individual sheets, they first need to be separated from each other. The paper feed systems in printers, scanners, copiers or faxes are a common examples of the need to sequentially feed individual sheets from a stack into a paper feed path. Given the widespread use of such devices, the invention will be described with particular reference to its use within this context. However, this is purely for the purposes of illustration and should not be seen as limiting the scope of the present invention. It will be appreciated that the invention has much broader application and may be suitable for many systems involving the handling of stacked sheet material.

Printers, copiers, scanners, faxes and the like, sequentially feed sheets of paper from a stack in the paper tray, past the imaging means (e.g. printhead), to a collect tray. There are many methods used to separate single sheets from the stack. Some of the more common methods involve air jets, suction feet, rubberized picker rollers, rubberized pusher arms and so on. In the systems that use a pick up roller or pusher arm, it is important to control the force with which the roller touches the top sheet of the stack to drive, push or drag it off the top. The friction between the top sheet and the pusher or roller needs to exceed the friction between the top sheet and the sheet underneath. Too much force can cause two or more sheets to be drawn from the stack (known as 'double picks'), and too little will obviously fail to draw any sheets.

Sheet feed mechanisms should also be relatively simple, compact and have low power demands. For example, consumer expectations in the SOHO (Small Office/Home Office) printer market are directing designers to reduce the desktop footprint, improve feed reliability for a variety of paper grades while maintaining or reducing manufacturing costs.

SUMMARY OF THE INVENTION

Accordingly the present invention provides a sheet feed mechanism comprising:

a chassis configured to support a stack of sheets;

a top sheet engaging member for engaging the top-most sheet of the stack and moving it relative to the remainder of the stack;

a stack engaging structure for engaging the stack and biasing its top sheet against the top sheet engaging member, the stack engaging structure having a friction surface extending parallel to the stack engaging structure's direction of travel;

a lock mechanism mounted to the chassis for limited relative movement thereto, the lock mechanism having a biased contact foot for engaging the friction surface to secure the stack engaging structure to the lock mechanism for movement therewith; and, an actuator mounted to the chassis to disengage the contact foot from the friction surface such that the stack engaging structure moves relative to the lock mechanism to press the top-most sheet against the top sheet engaging, then the actuator disengages the contact foot such that it re-engages the friction surface and then moves the lock mechanism relative to the chassis such that the stack engaging structure also retracts a predetermined distance from the top-most sheet engaging member.

A sheet feed mechanism according to the invention has relatively few moving parts and can be embodied in a simple, yet compact arrangement. It requires only a single actuator for engaging the lock mechanism with the other elements being biased using non-powered integers such as springs. Therefore the sheet feed has a small power load on the printer or overall device. As the actuator always retracts the stack a set distance from the top sheet engaging member, the feeder works reliably with paper of different thicknesses.

Preferably the stack engaging structure has a resilient member to lift the stack such the top-most sheet of the stack is biased against the top sheet engaging member, the biasing force of the resilient member decreases as it elevates the stack, such that as the thickness and weight of the stack decreases, the biasing force likewise decreases and the top-most sheet is biased against the top sheet engaging member with substantially uniform force.

Preferably the actuator is a rotating cam. In another preferred form, the top-sheet engaging member is a rubberized picker roller that rotates to draw the top-most sheet from the stack.

Preferably the lock mechanism has a lock arm hinged to the chassis and a first class lever pivoted to the lock arm, the contact foot being on one side of the level and the other side of the lever being configured for engagement with the cam in order to lift the contact foot from the friction surface. In a further preferred form the chassis further comprises a stop formation formed proximate the cam, and the lock mechanism has a bearing structure fixedly mounted to the lock arm, the bearing structure having a bearing surface for abutting the stop, and the lock mechanism also having a resilient member between the bearing structure and the lever arm opposite the contact foot for biasing the contact foot into engagement with the friction surface. In a particularly preferred embodiment the first class lever is generally U-shaped with a first and second side arms separated by a cross piece, and the cam being positioned between the first and second side arms for engagement each alternatively, wherein the first side arm forms the lever arm that actuates to contact foot to disengage the friction surface, and the second arm provides the bearing surface against which the can acts to push the lock arm and the stack engaging structure such that the stack retracts from the top-most sheet engaging member. In a specific embodiment the pivot is positioned near the first side arm end of the cross piece, the contact foot is positioned near the second side arm end of the cross piece, and the cam rotates such that any friction between the cam and the second side arm serves to urge the contact foot into engagement with the friction surface.

Preferably the stack engaging structure is a stack lifting arm hinged to the chassis along the same hinge axis as the lock arm. In a further preferred form the friction surface is an arcuate section having a center of curvature on the hinge axis of the lifter arm and fixed for rotation therewith. In a particularly preferred embodiment the stack lifter arm and the arcuate section are mounted to, and spaced apart by, a shaft rotatably mounted to the chassis, the axis of the shaft being collinear with the hinge axis for the lifter arm and the lock arm, and the lifter arm being biased to lift the stack by a coil spring coiled around the shaft. Inserting the hinge shaft through the coil spring is an effective space saving technique. Likewise, configuring the lock arm and the lifter arm to rotate instead of move linearly allows the friction surface along the arcuate section to be shorter.

BRIEF DESCRIPTION OF THE DRAWINGS

Specific embodiments of the invention will now be described by way of example only with reference to the accompanying drawings in which.

DETAILED DESCRIPTION OF PREFERRED EMBODIMENTS

FIGS. 1 to 5 show one form of the sheet feed mechanism in a diagrammatic form for ease of understanding. The sheet feed mechanism 1 is typically used in a larger device such as a printer or the like and would likely have its chassis 2 integrated with that of the printer. The sheet feed mechanism 1 lifts the stack of sheets 4 to the picker roller 6 that draws a single sheet into the printer sheet feed path (not shown). Instead of a picker roller, the sheet feed mechanism could also lift the stack toward a suction shoe or other sheet engaging means.

Figure 1:
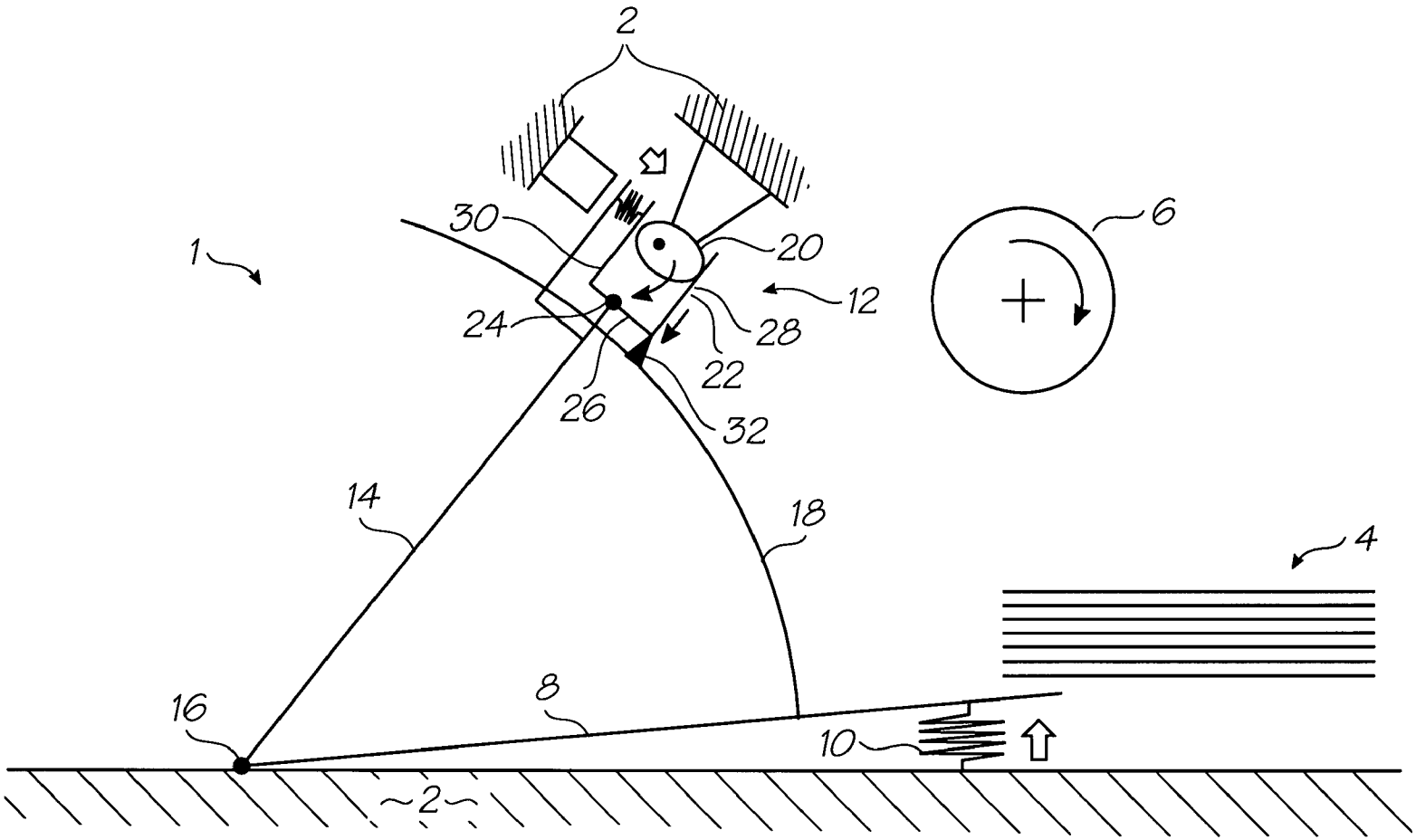
FIGS. 1 to 5 is a diagrammatic illustration of one embodiment of the invention at various stages of its operation.

Referring to FIG. 1, the stack 4 is inserted into the designated part of the device such as the paper tray of the printer (not shown) while the lift arm 8 is in a lowered position. The lift arm 8 is biased upwards by the lift spring 10 but is held in the lowered position by the lock mechanism 12. The lock mechanism 12 is at the distal end of the lock arm 14 which is hinged to the chassis 2 at the same hinge axis 16 as the lift arm 8. The lock mechanism releasably secures the lock arm 14 to the lift arm 8 via the friction surface 18. The lock mechanism 12 abuts the cam 20 to prevent the lock arm 14 and the lift arm 8 from rotating upwards because of the biasing force of the lift spring 10.

Figure 2:
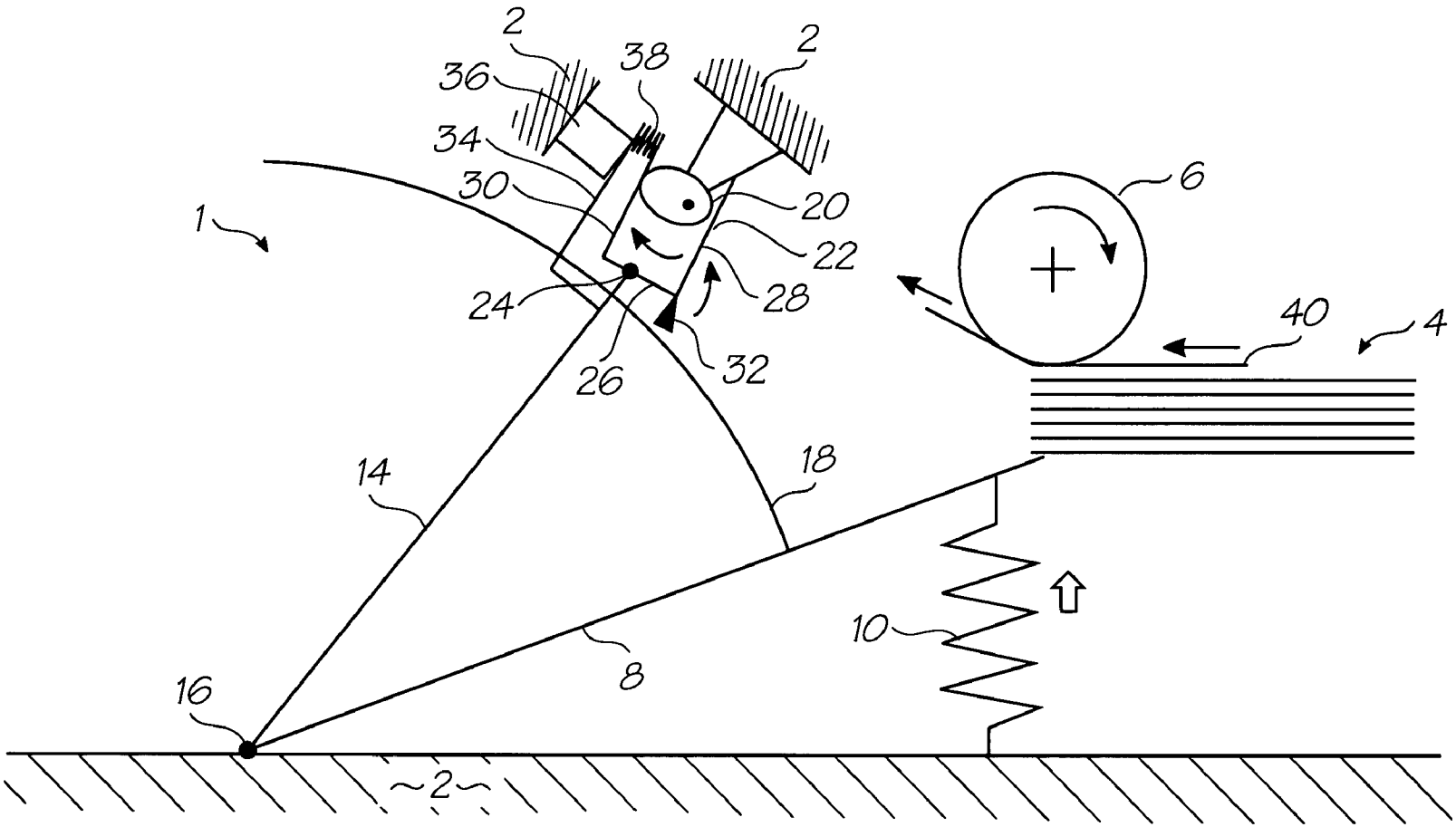

Referring to FIG. 2, the cam 20 rotates clockwise in response to a paper feed request signal from the printer. The cam 20 is positioned within a U-shaped member 22 of the lock mechanism 12. The U-shaped member 22 is hinged to the lock arm 14 at the hinge 24. The hinge 24 is on the cross piece 26 separating the engagement arm 28 and the disengagement arm 30 on either side of the 'U'. The contact foot 32 is attached to the cross piece 26 on the opposite side of the lock hinge 24 to the disengagement arm 30 to form a first class lever. Rotating the cam 20 clockwise uses the friction generated between the cam 20 and the engagement arm 28 to urge the contact foot 32 into firmer engagement with the friction surface 18. This helps to avoid any slippage between the contact foot and the friction surface before the cam 20 engages the disengagement arm 34. Slippage can allow the lift arm 8 to press the top-most sheet 40 onto the picker roller 6 before other components in the printer feed path are ready to receive a sheet.

As the cam 20 rotates out of engagement with the engagement arm 28, the lift spring 10 pushes the lift arm 8, locking surface 18 and locking arm 14 upwards until the bearing surface 34 abuts the stop 36 on the chassis 2. The cam 20 continues to rotate until it contacts the disengagement arm 30. Further rotation presses the disengagement arm 30 towards the bearing surface 34 against the bias of the lock spring 38. This actuates the lever to lift the contact foot 32 out of engagement with the friction surface 18. This unlocks the lift arm 8 from the lock arm 14. This allows the lift spring 10 to elevate the stack 4 until the top-most sheet 40 engages the picker roller 6 and is drawn away from the remainder of the stack.

Figure 3:
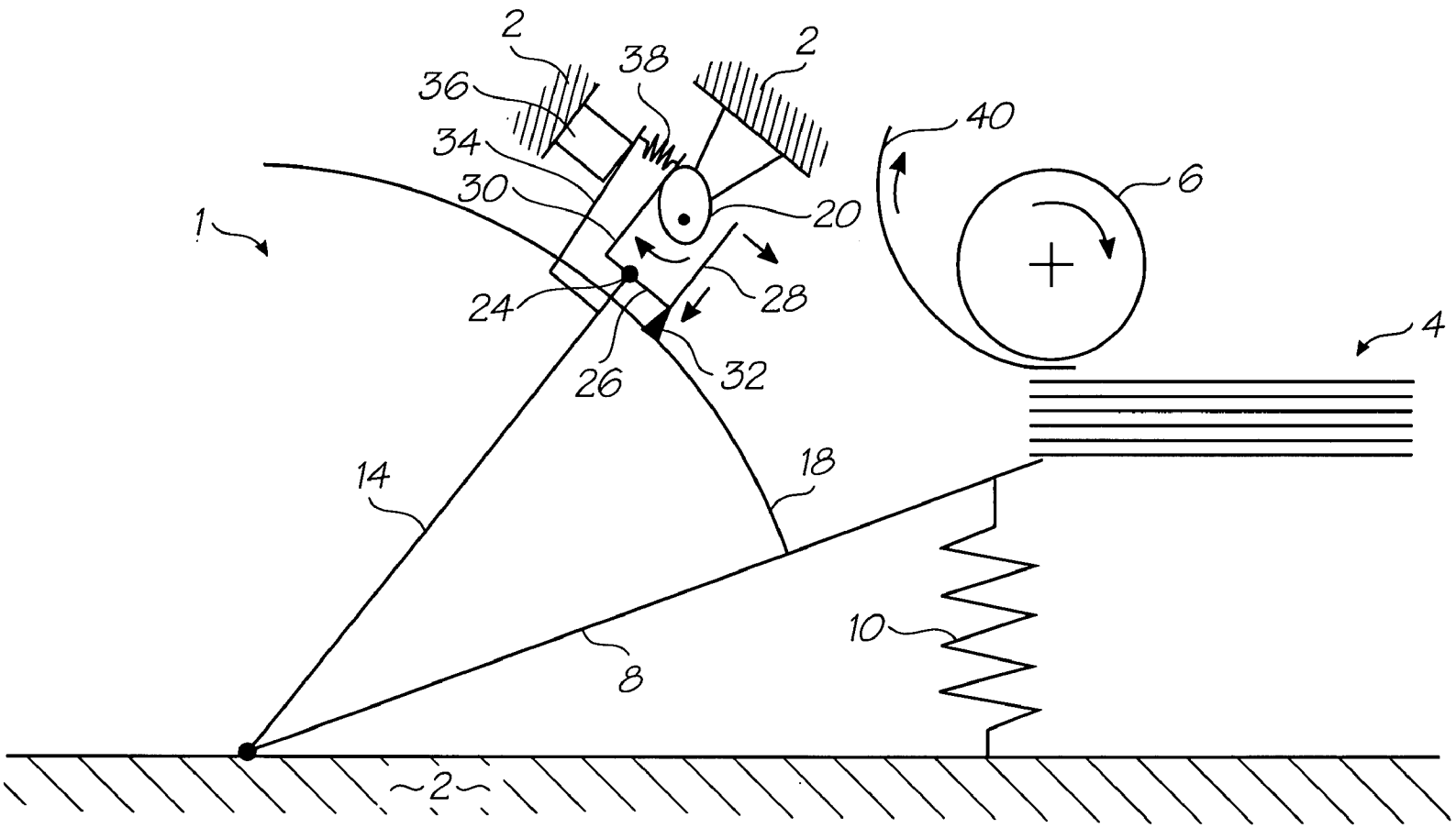

Referring to FIG. 3, the cam 20 continues to rotate and allow the lock spring 38 to push the disengagement arm 30 away from the bearing surface 34. This in turn re-engages the contact foot 32 with the friction surface 18 to lock the lock arm 14 and the lift arm 8 together. The picker roller 6 continues to draw the top-most sheet 40 from the stack 4.

Figure 4:
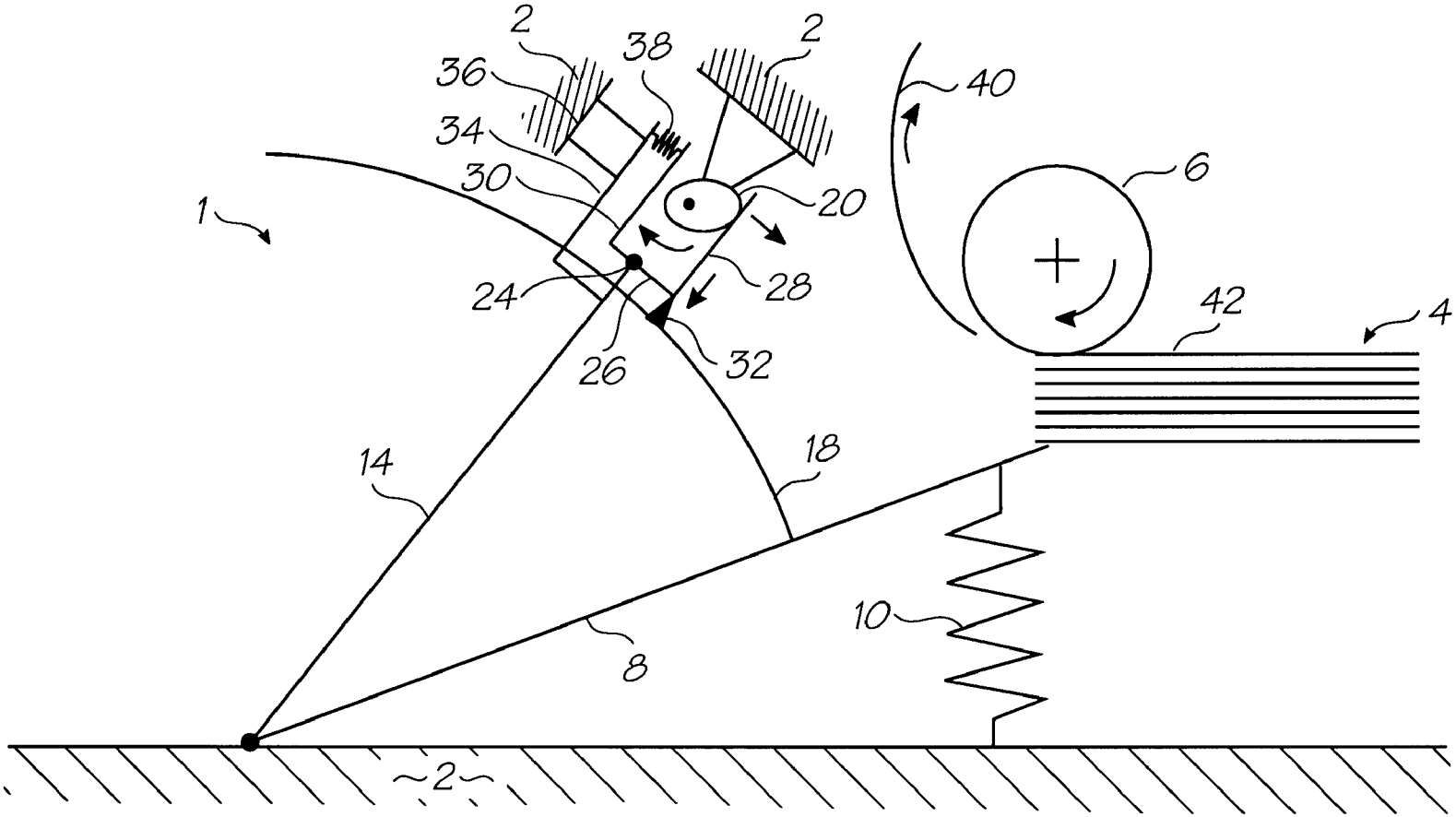

Turning to FIG. 4, the cam 20 rotates into contact with the engagement arm 28 to add to the force with which the contact foot 32 presses onto the friction surface 18. At this point, the cam 20 also starts to push the engagement arm 28 and therefore the lock arm 14 and lift arm 8 clockwise against the bias of the lift spring 10. Accordingly, the stack 4 starts to drop away from the picker roller 6 before it draws the new top-most sheet 42 off the stack 4.

Figure 5:
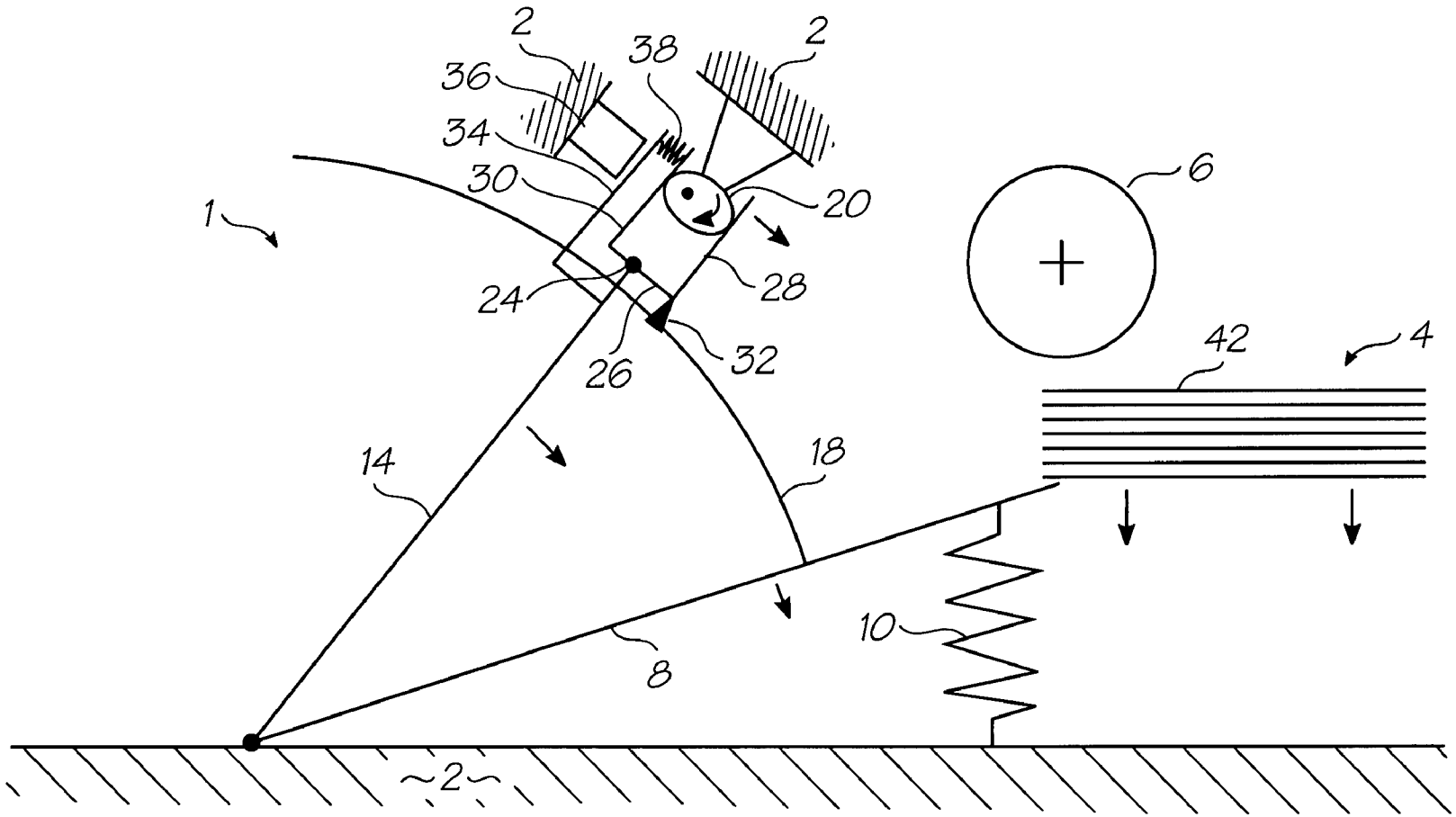

FIG. 5 shows the sheet feed mechanism at the completion of its operative cycle. The cam 20 rotates until the high point is in contact with the engagement arm 28. This pushes the lock arm 14 and the lift arm 8 back through a set angle of rotation. In turn, the sack 4 retracts from the picker roller 6 by a predetermined distance. This distance does not alter regardless of the grade (or thickness) of paper in the stack. Because of this, the lift spring 10 need only compress a small amount and therefore the energy consumed by the mechanism as it indexes through the stack is reduced. Furthermore, as the stack 4 depletes, it weighs less but the spring 10 also decreases its force biasing the stack against the picker roller 6 because it is less compressed. This keeps the force pressing successive top-most sheets against the picker roller substantially uniform.

Figure 6:
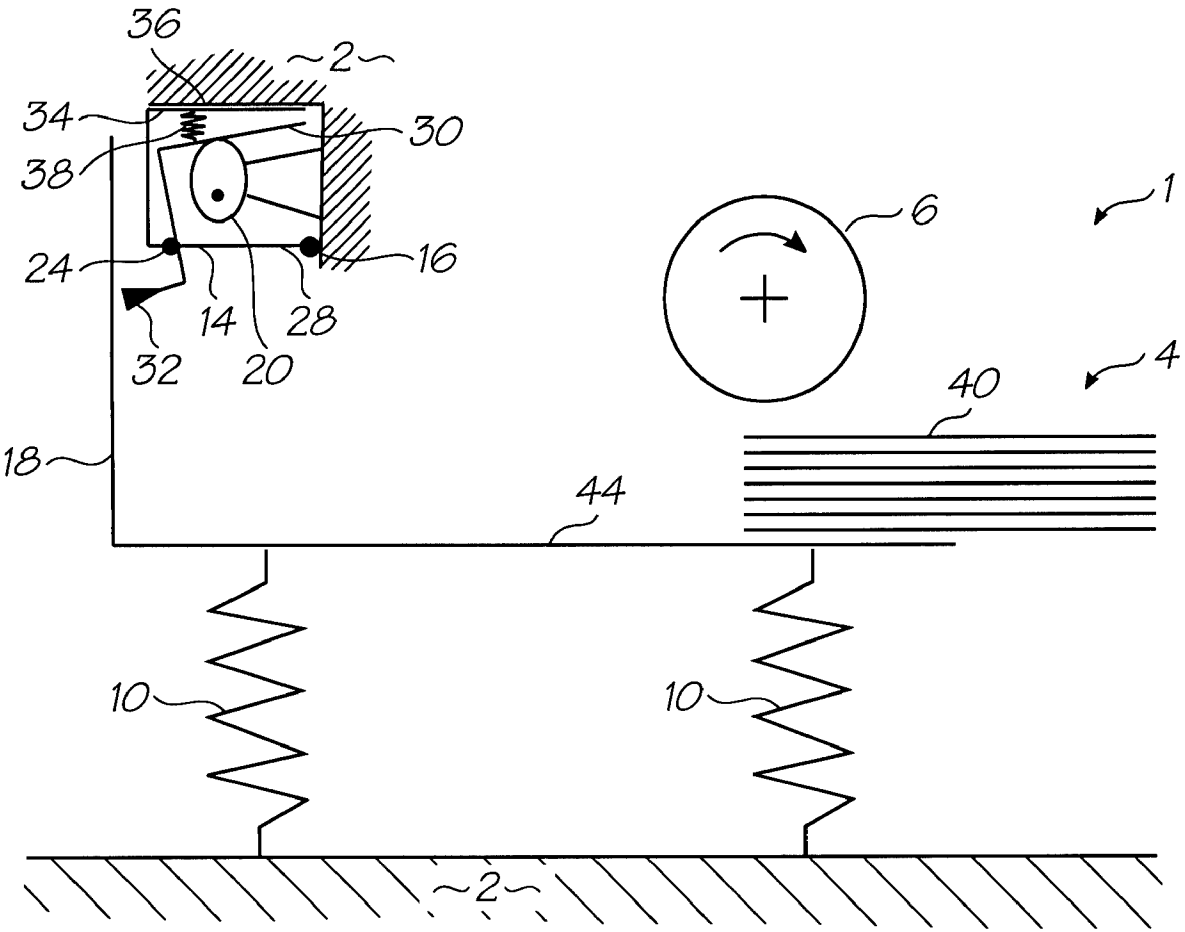
FIG. 6 is a diagrammatic illustration of another embodiment of the invention.

FIG. 6 is a diagrammatic illustration of another embodiment of the sheet feed mechanism 1. In this embodiment, the hinged lift arm is replaced with a lift structure 44 that has rectilinear movement instead of rotational. The friction surface 18 is on an arm that extends upwardly to be parallel with the direction of travel of the lift structure 44. The lock arm 14 is again hinged to the chassis 2 and has a bearing surface 34 with lock spring 38 to bias the contact foot 32 into locking engagement with the friction surface 18. The disengagement arm 30, lock hinge 24 and the contact foot 32 again form a first class lever.

The embodiment shown does not use a U-shaped member but instead configures the lock arm 14 to act as the engagement arm 28 as well. When the cam 20 contacts the engagement arm 28, it rotates anti-clockwise about the hinge 16. The contact foot 32 maintains locking engagement with the friction surface 18 because the spring 38 continues to bias the disengagement arm 30 in a clockwise direction despite the rotation of the engagement arm in an anti clockwise direction. In fact the bearing surface 34 rotating anti clockwise tends to maintain the gap bridged by the spring 38 so that the biasing force remains relatively uniform.

The embodiment shown in FIG. 6 demonstrates that the invention can adopt many different configurations to suit specific functional requirements and space limitations. Ordinary workers in this field will also appreciate that the cam may be replaced by the solenoid actuator or pneumatic/hydraulic actuators. Any dual action actuator that contacts the disengagement arm and the engagement arm in succession will be suitable for the purposes of this invention.

Figure 7:
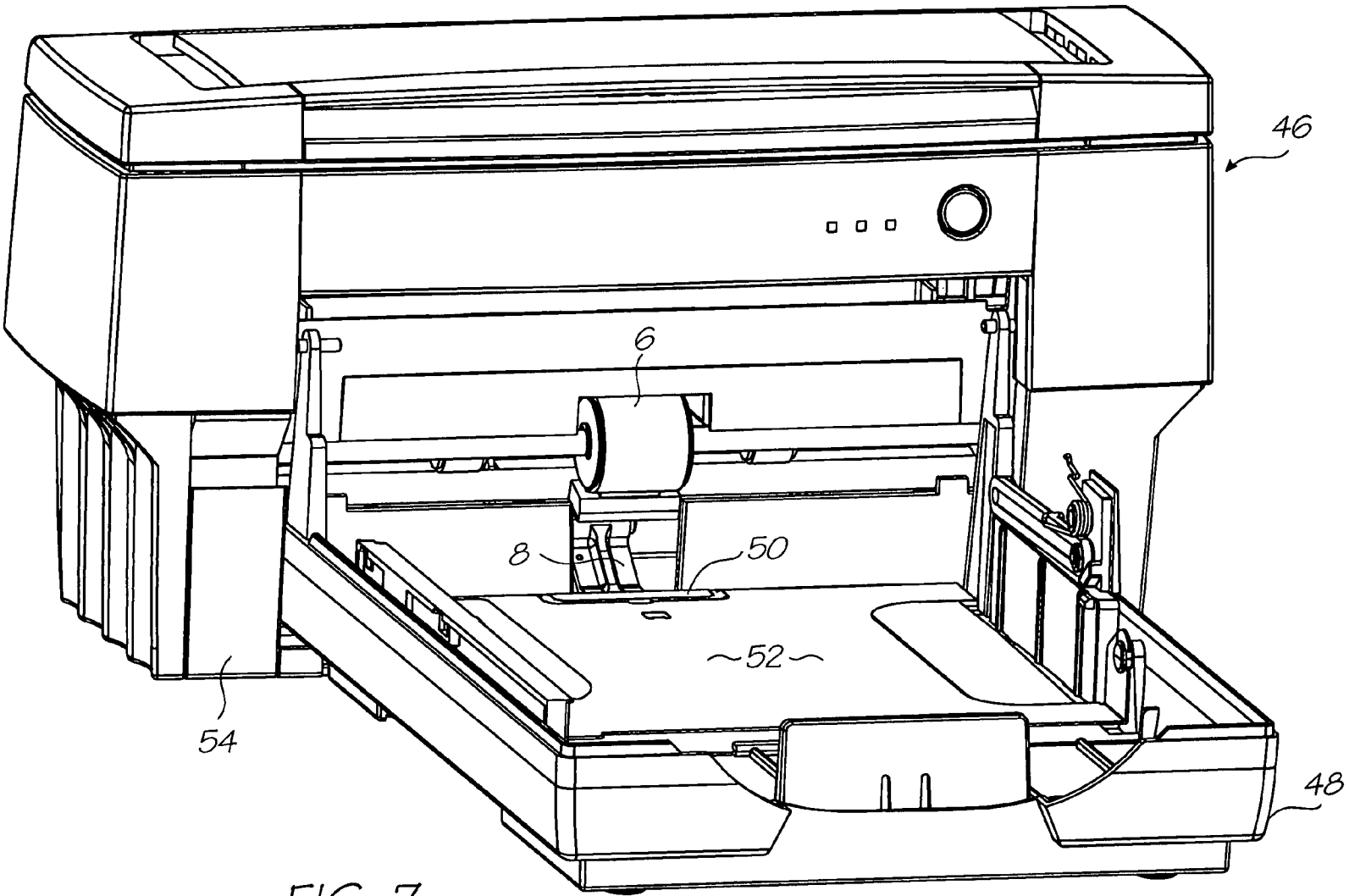
FIG. 7 is a perspective view of an inkjet printer and paper feed tray for use with the invention.

FIG. 7 shows the invention incorporated into a SOHO printer. The printer 46 has a paper feed tray 48 for receiving a ream of blank paper (not shown). The paper feed assembly in the printer draws sheets sequentially from the stack placed in the feed tray 48 and directs it then through a C-shaped paper path past a printhead. After printing the pages are collected from a collection tray (not shown) on top of the feed tray 48.

The lift arm 8 is positioned directly beneath the picker roller 6 with the distal end 50 of the lift arm positioned beneath the leading edge of the stack of sheets (not shown). Initially the lifter arm is held in a fully depressed configuration so that its distal end is flush with the paper support platen 52 in the feed tray 48. The lift arm 8 is forced into this initial position using the lift arm reset lever 54 described in greater detail below.

Figure 8:
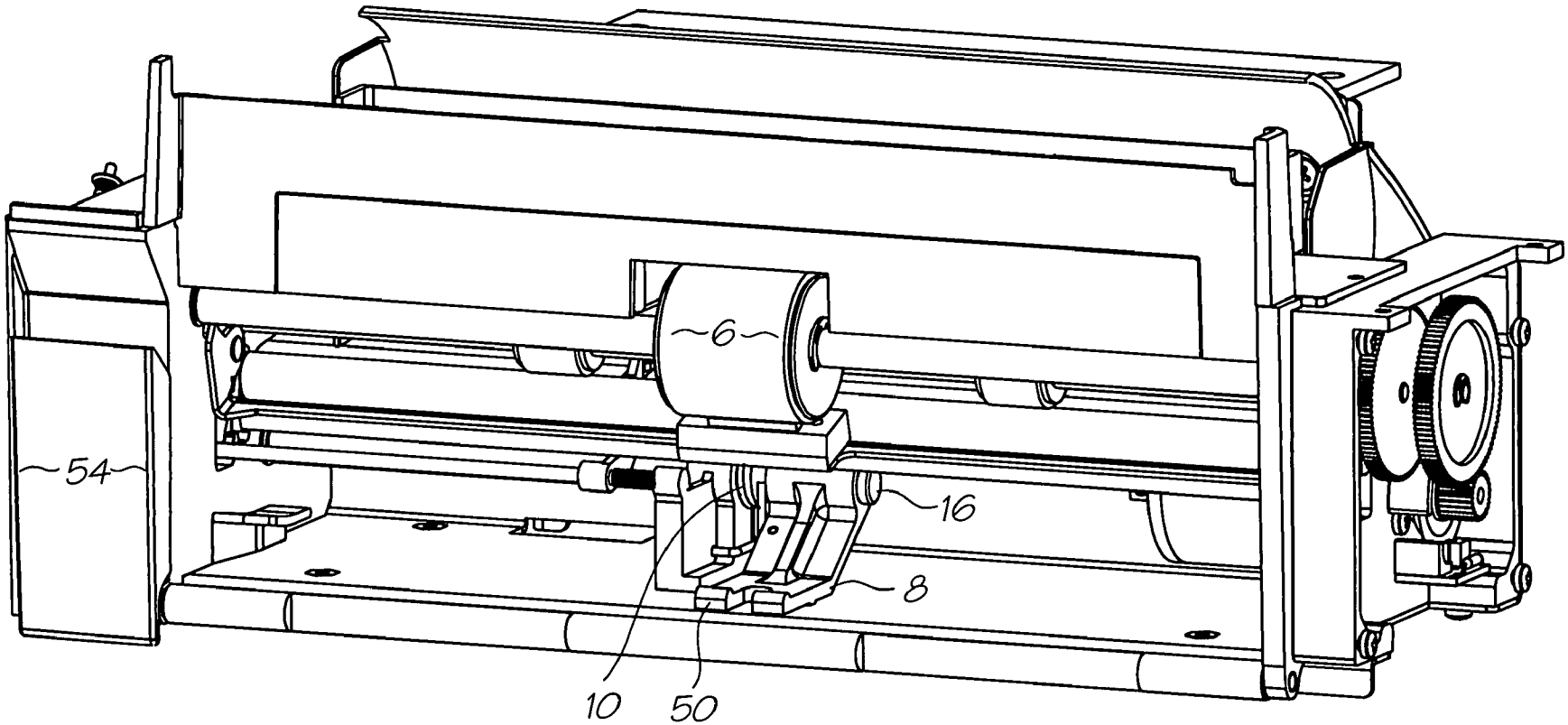
FIG. 8 is a perspective of the printer shown in FIG. 1 with the paper feed tray and the outer housings removed to expose the components of the invention.

Turning to FIG. 8, the feed tray and outer housing have been removed for clarity. Again the lift arm 8 is in its lowered initial position so that the distal end 50 lies beneath the leading edge of the paper stack. Coil spring 10 biases the lifter arm upwards about the hinge shaft 16. However the lock mechanism (described below) holds the lifter arm in its initial position until the actuator responds to a request for a sheet.

Figure 9:
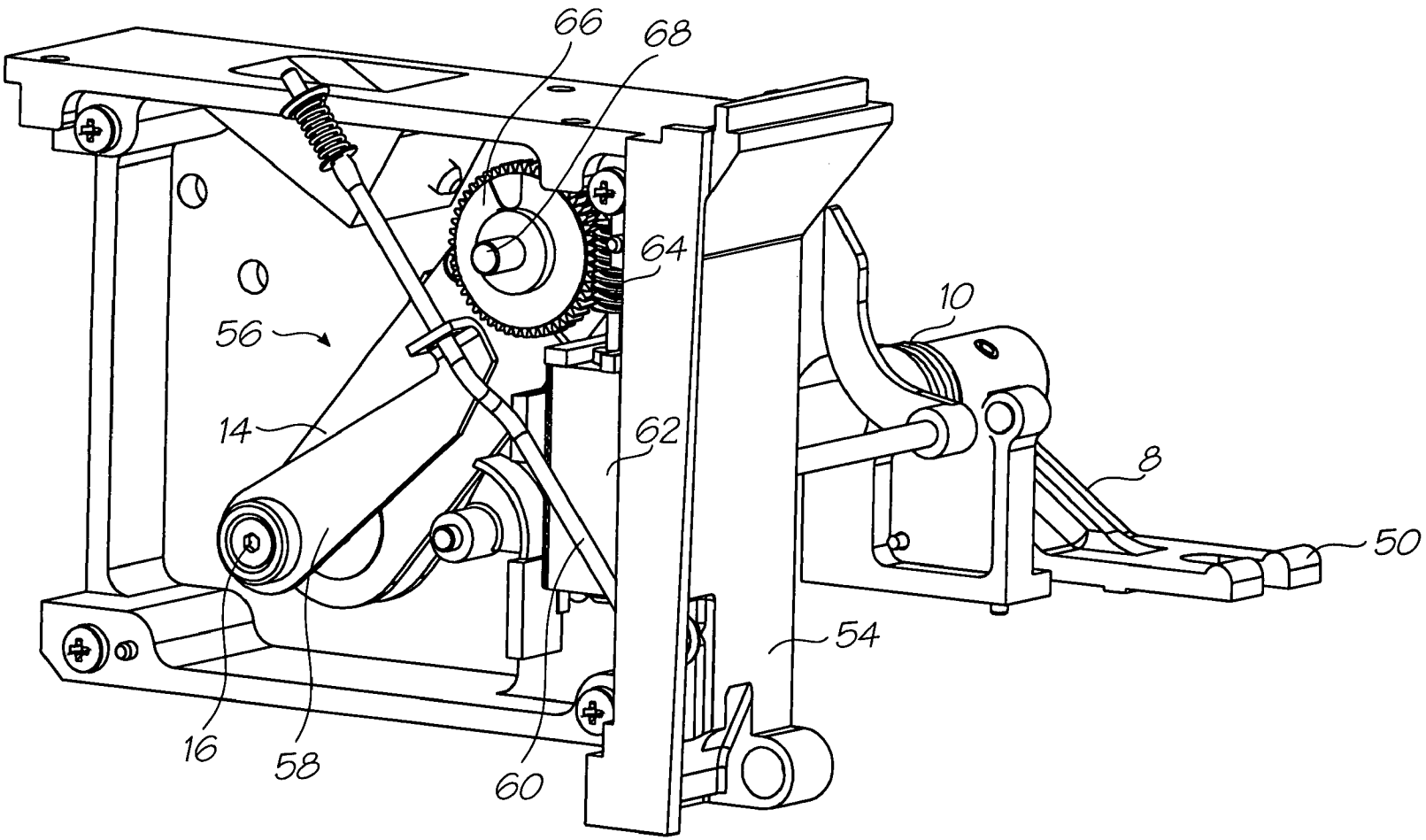
FIG. 9 is a perspective of the invention shown in FIG. 8 with the majority of the unrelated printer components removed.

In FIG. 9 more components of the printer have been removed to expose the lock mechanism. Hinge shaft 16 extends from the lifter arm 8 through the lock spring 10 to the locking assembly 56. On the outer most end of the hinge shaft 16 is the reset arm 58, which is connected to the reset lever 54 via the connecter rod 60. The reset arm 58 is mounted to the hinge at shaft 16 via a ratchet engagement that locks the shaft and arm together when rotating clockwise that allows the arm to rotate anti-clockwise while the shaft remains fixed. In this way the user simply depresses the lifter arm reset lever 54 to draw down the reset arm 58 and therefore the lifter arm 8 against bias of the spring 10.

Also shown in FIG. 9, is the cam drive motor 62 with its output worm drive 64 meshed with the drive gear 66 mounted on the cam shaft 68. One side of the lock arm 14 is also shown and this is described in greater detail below.

Figure 10:
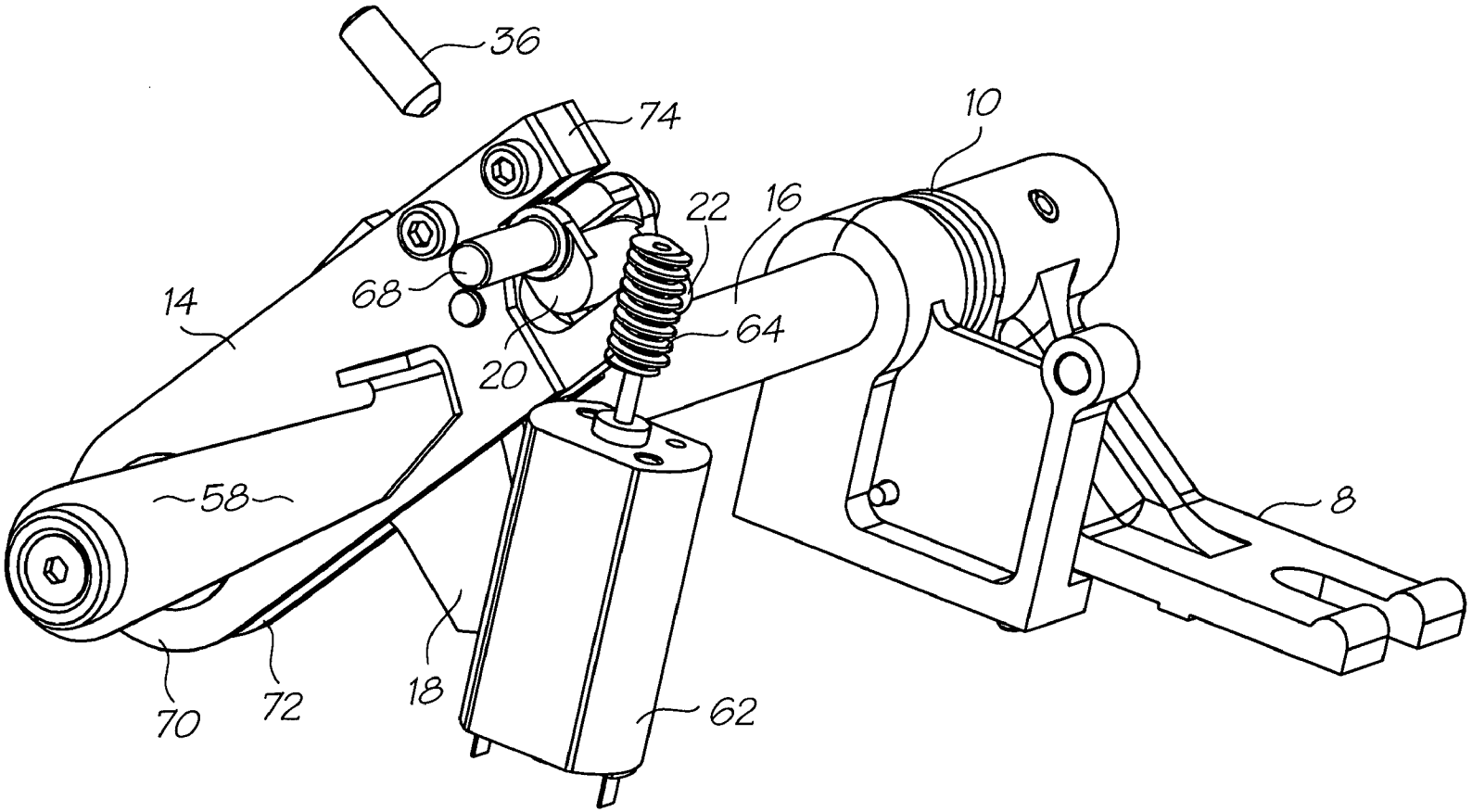
FIG. 10 is a perspective of the components of the present invention shown in FIG. 9 with unrelated components of the printer removed.

FIG. 10 shows the feed mechanism with further components removed for clarity. The lock arm 14 has two side plates 70 and 72 mounted to the hinge shaft 16. The distal ends of the side plates 70 and 72 are connected by the abutment block 74 positioned to abut the stop 36 secured to the printer chassis. Mounted between the side plates 70 and 72 is the arcuate friction arm 18 and the U-shaped member 22. The side plates 70 and 72 are rotatably mounted to the hinge shaft 16 while the arcuate friction arm 18 is fixed to the shaft 16.

Figure 11:
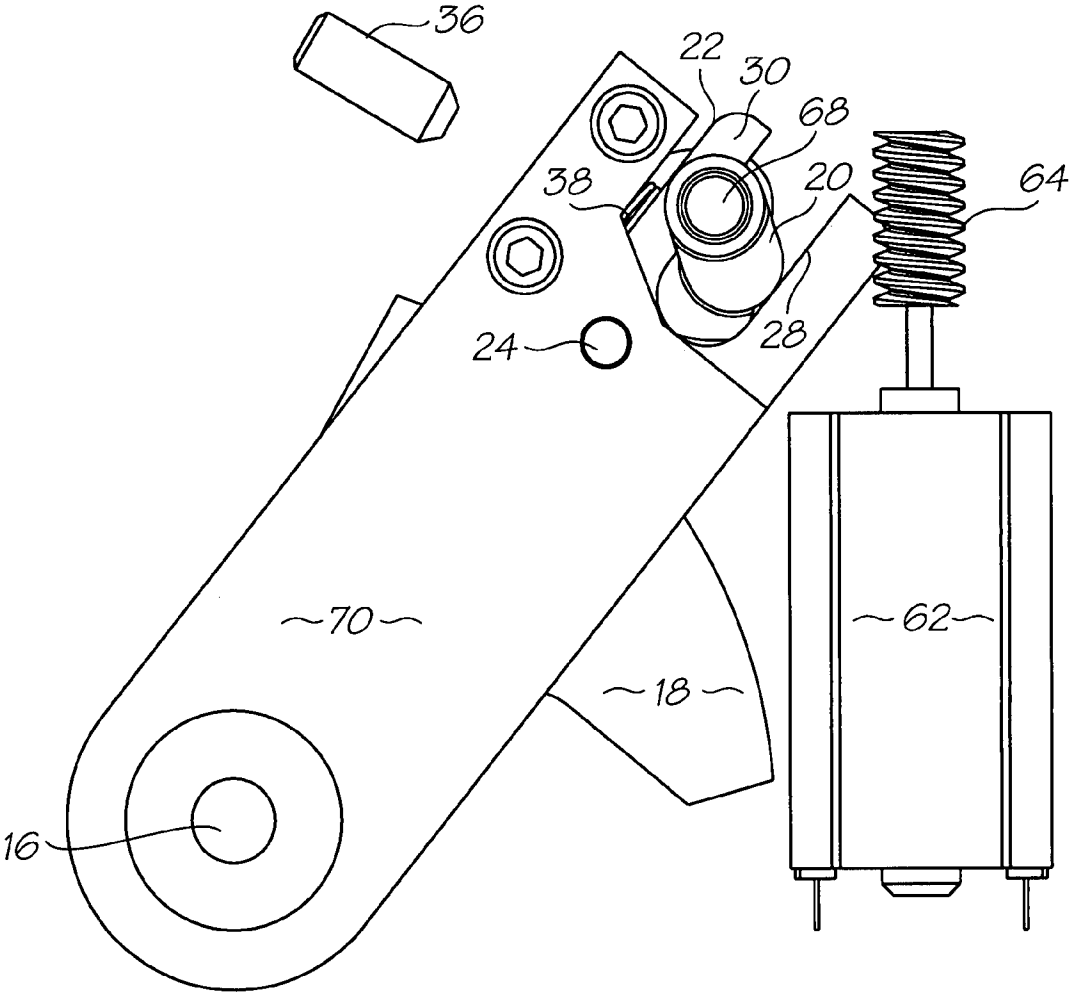
FIG. 11 is an elevation showing the drive motor, lock arm and lock surface in isolation.

Referring to FIG. 11, the cam 20 is shown between the sides of the U-shaped member 22. In response to a sheet feed request, the cam 20 starts rotating clockwise along the engagement arm 28. It will be appreciated that the contact foot is urged into engagement with the arcuate friction arm 18 by any friction between the cam 20 and the engagement arm 28. This is because the contact foot is between side plates 70 and 72 (not shown), to the right of the lock mechanism hinge 24. Of course the lock spring 38 also pushes the contact foot into locking engagement.

Figure 12:
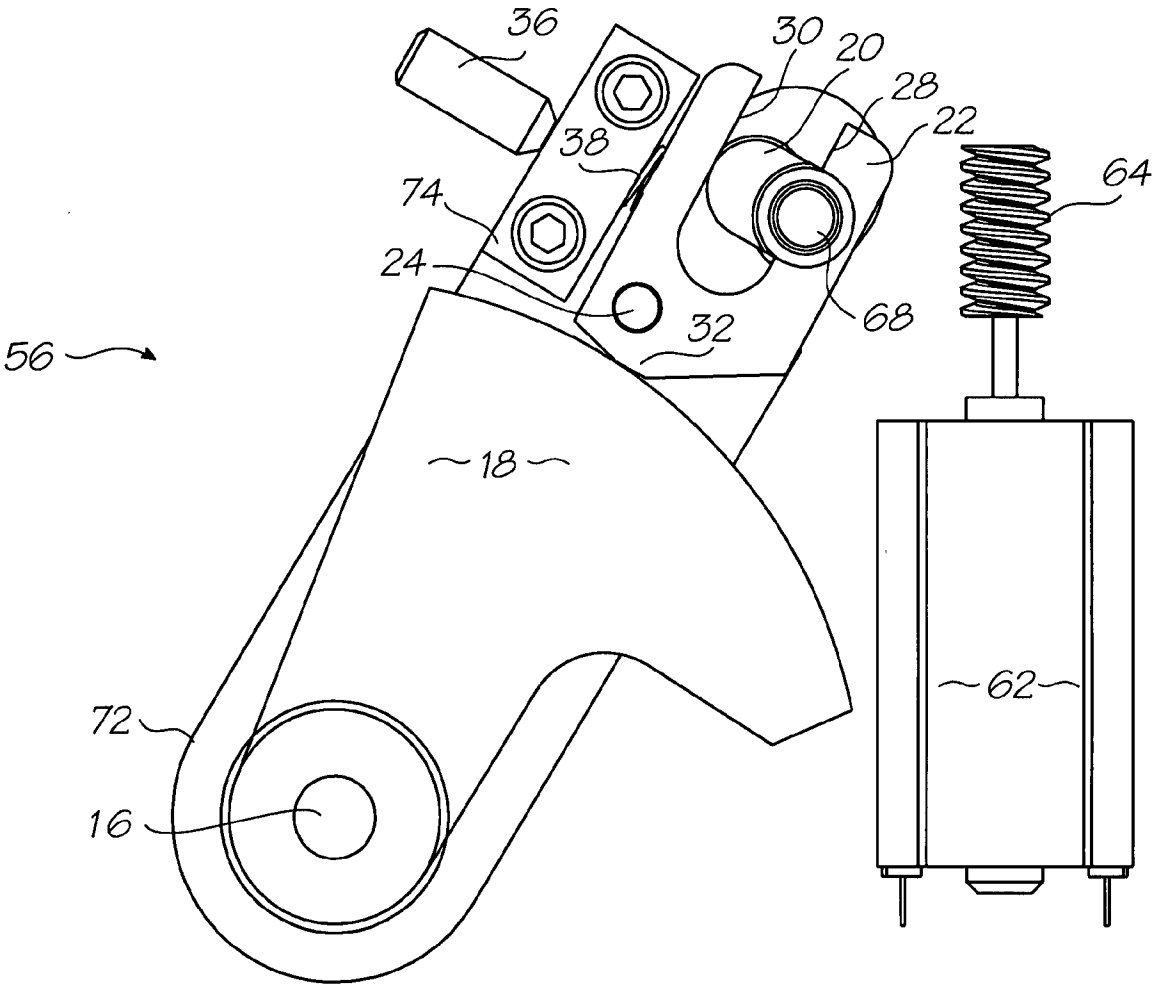
FIG. 12 is the elevation of FIG. 11 at the fully unlocked stage of its operating cycle and with one side of the lock arm removed.

FIG. 12 shows the locking assembly in the unlocked condition. The locking assembly 56 is shown with the side plate 70 removed. The cam 20 has rotated to press against the disengagement arm 30 of the U-shaped member 22. The cam 20 initially pushes the entire assembly 56 such that it rotates into engagement with the stop 36. After engaging the stop 36 the cam then rotates the U-shaped member anti-clockwise about the lock mechanism hinge 24. This lifts the contact foot 32, or rather simply unweights it from the arcuate surface on the arcuate friction arm 18. With the arcuate friction arm now free to rotate it is urged in an anti-clockwise direction by hinge shaft 16. Hinge shaft 16 is under the torque provided by the lifter spring 10 (see FIG. 10). Not shown in FIG. 12 is the elevation of the paper stack by the lifter arm 8 once the arcuate friction arm has been unlocked. The lift arm 8 continues to elevate the stack of paper until the top most sheet engages the picker roller 6.

Figure 14:
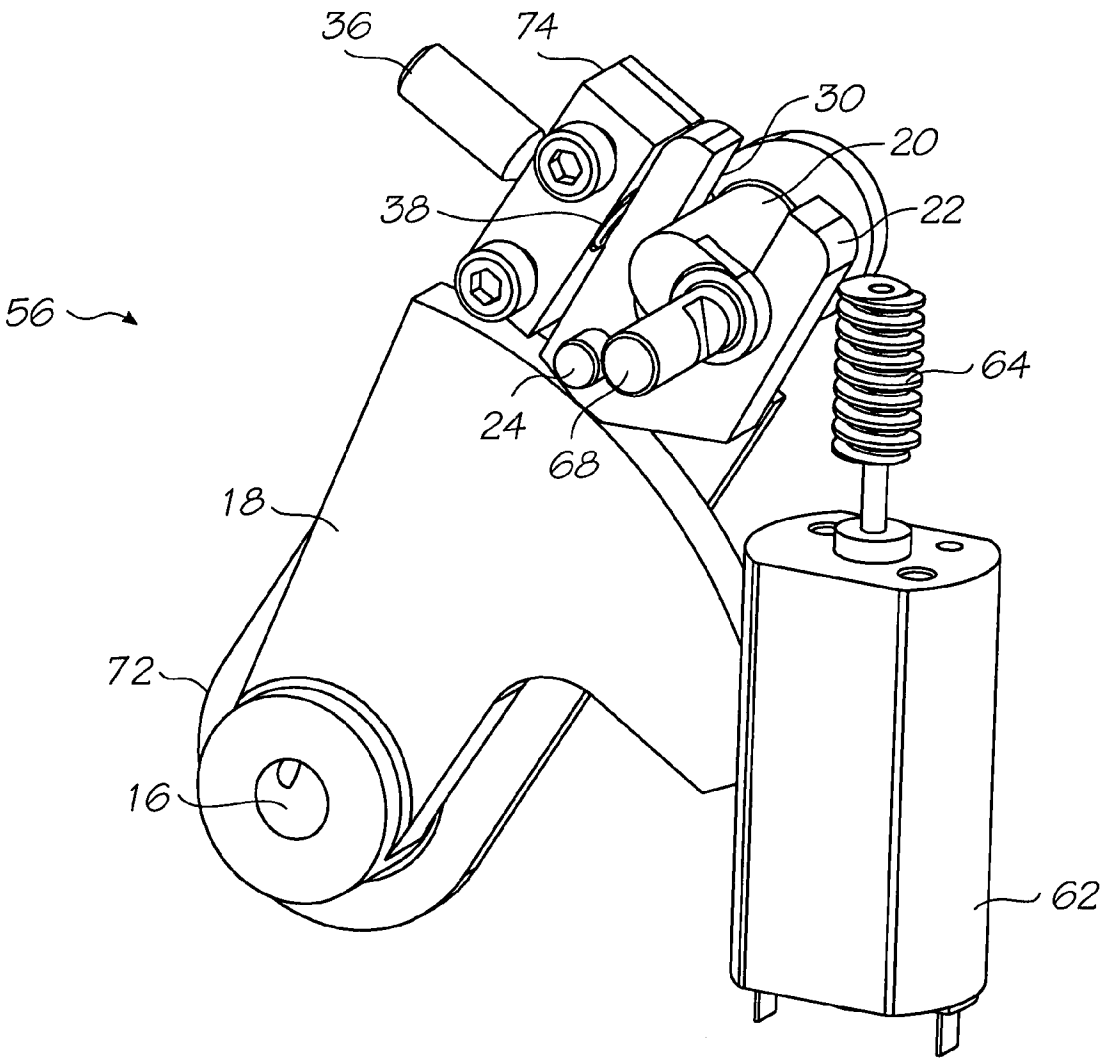
FIG. 14 is a perspective of the drive motor, lock arm and lock surface at the fully unlocked stage of its operation.

FIG. 14 shows the locking assembly in its unlocked condition in perspective. The U-shaped member 22 is rotated about the lock mechanism hinge 24 such that the disengagement arm 30 compresses the lock spring 38 against the abutment block 74. The contact foot 32 is levered out the engagement from the arcuate friction arm 18 to allow the lift arm 8 (see FIG. 10) to raise the paper stack.

Figure 13:
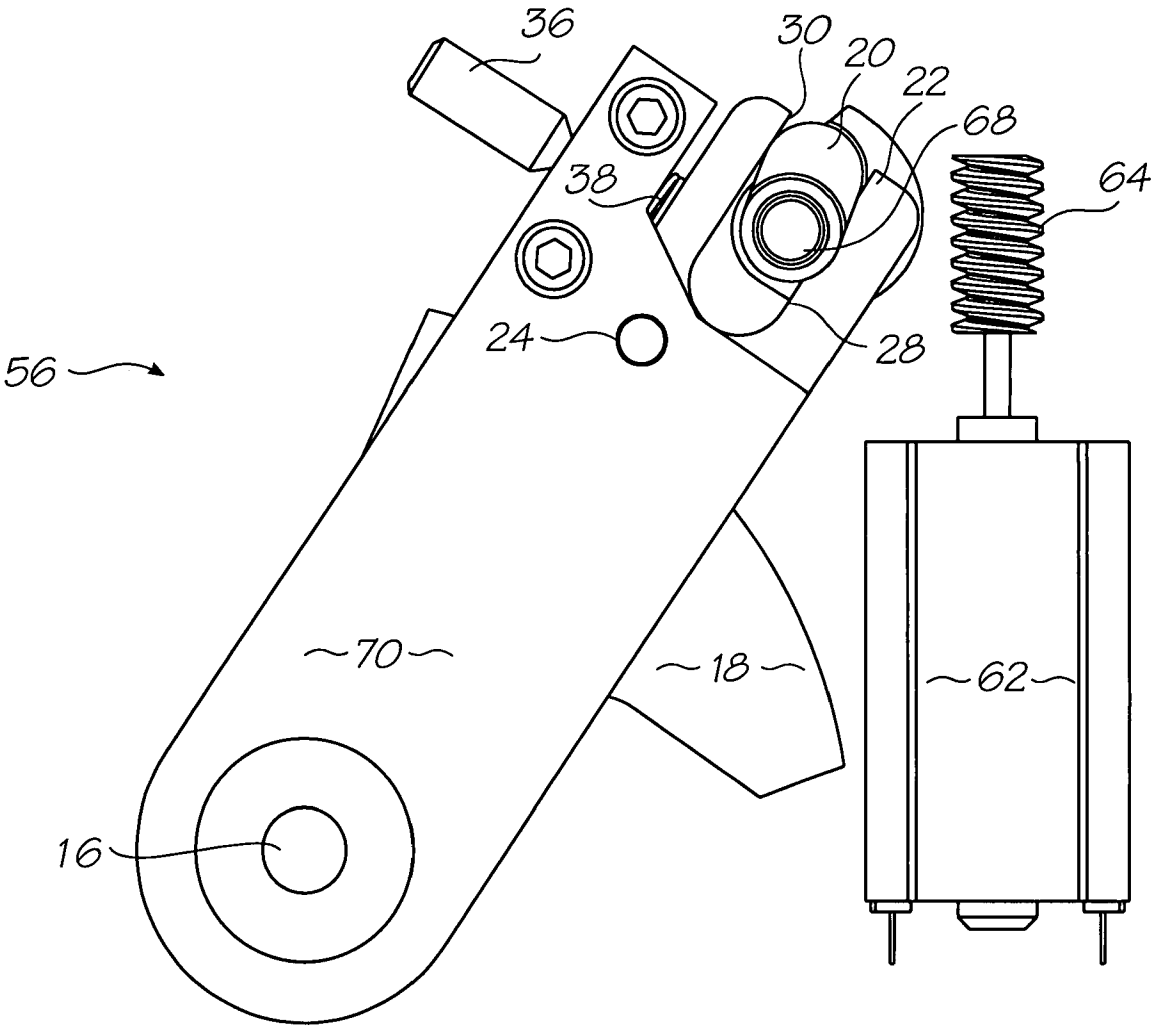
FIG. 13 is the elevation shown in FIG. 11 at the re-locking stage of its operating cycle.

FIG. 13 shows the locking mechanism 56 as the U-shaped member returns to the lock position. The cam 20 continues to rotate clockwise and allows the U-shaped member 22 to also rotate under the action of the lock spring 38. It should be noted that at this stage abutment block 74 is still against the stop 36. Furthermore, the paper stack is still pressed against the picker roller, which would still be drawing the top most sheet from the stack.

Figure 15:
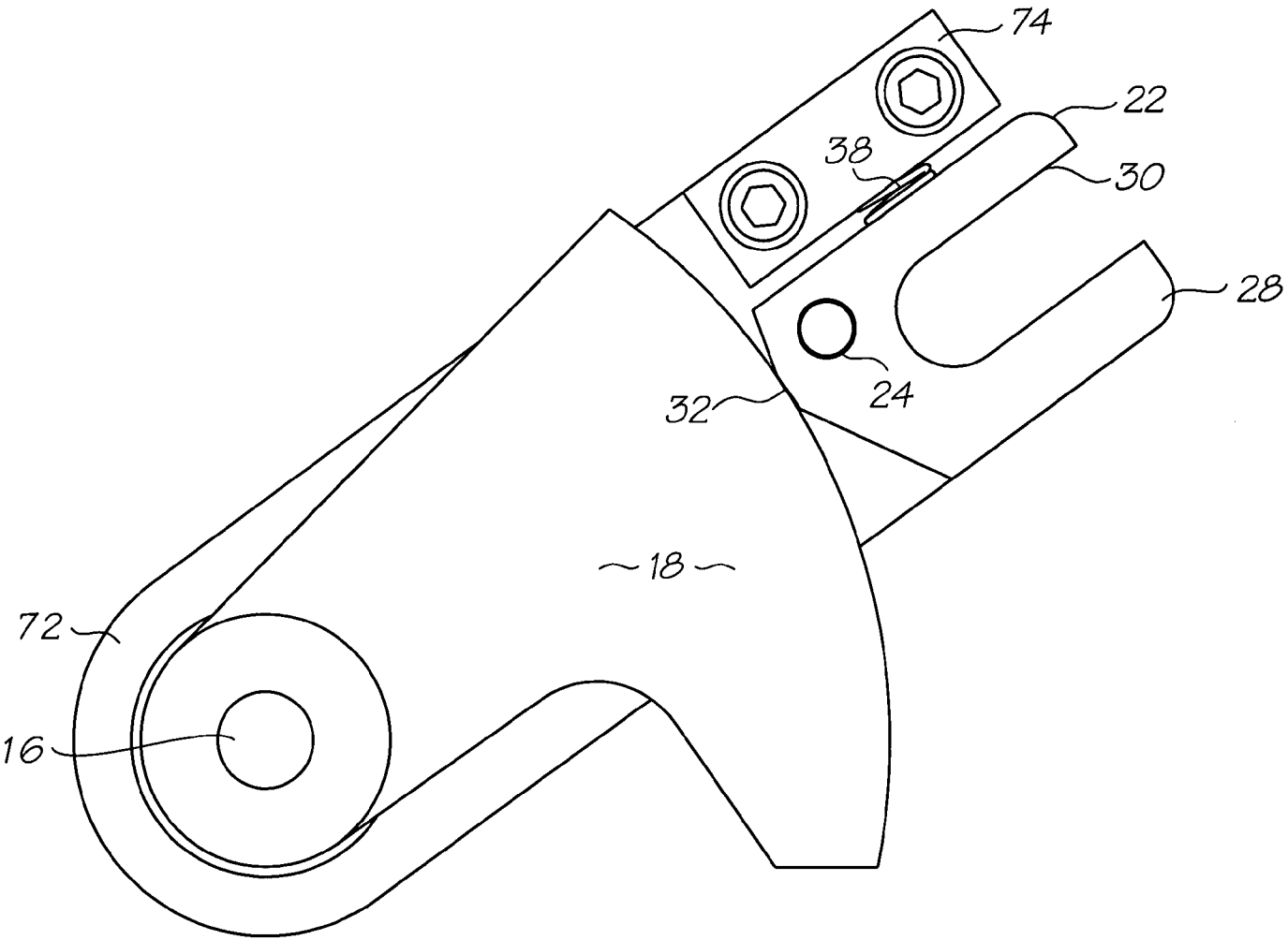
FIG. 15 is an elevation of one side of the lock arm and the lock surface in isolation; and, FIG. 16 is an elevation of the drive motor, lock arm and lock surface returned to the start of the operative cycle.

The locked configuration of the U-shaped member 22 and the arcuate friction arm 18 is best shown in FIG. 15. It can be clearly seen that the disengagement arm 30, the lock mechanism hinge 24 and the contact foot 32 form a first class lever whereby the biasing force of the lock spring 38 is amplified at the contact foot 32 by virtue of the mechanical advantage provided by the lever.

Figure 16:
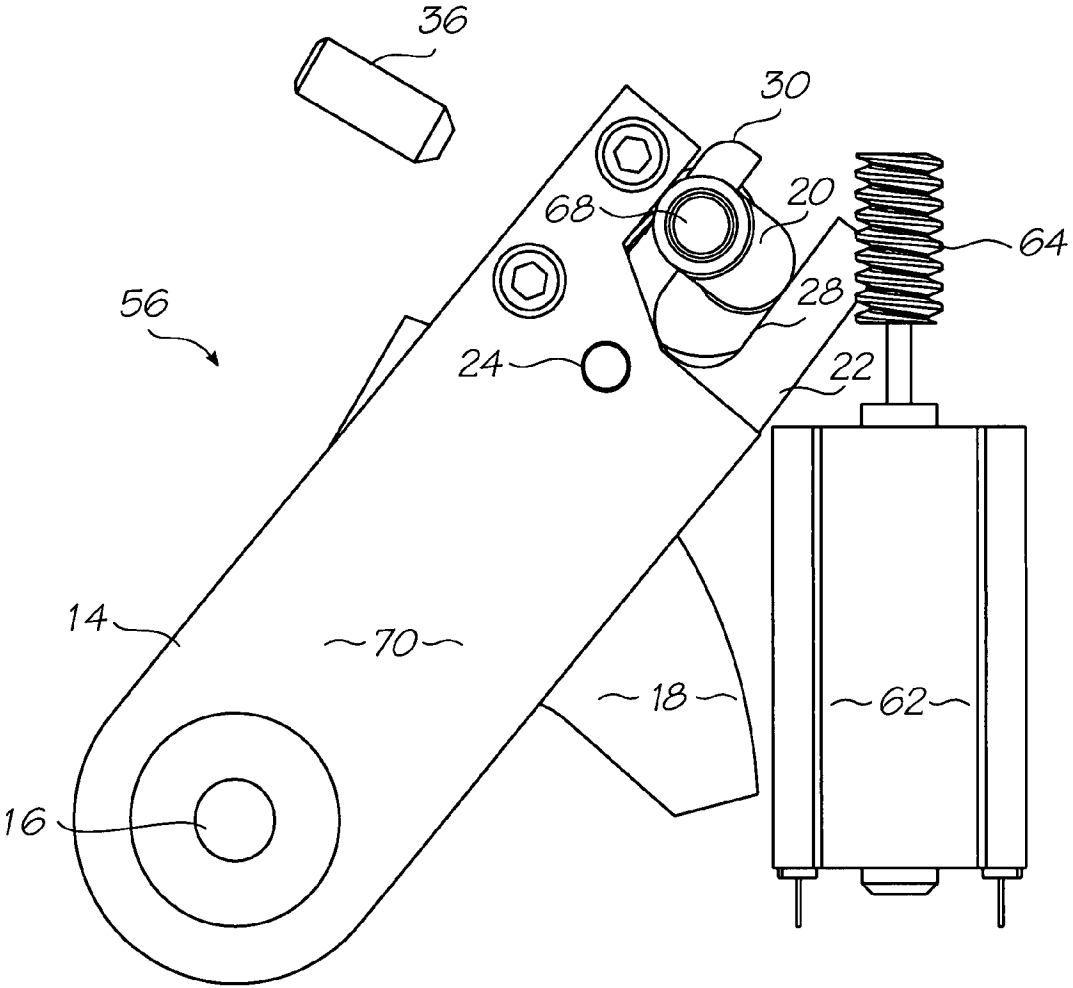

FIG. 16 shows the locking assembly returned to its initial configuration. The cam 20 has rotated back into engagement with the engagement arm 28 to rotate the entire assembly 56 about the hinge shaft 16, a small distance away from the stop 36. As the arcuate friction arm 18 and the lock arm 14 are now locked together the hinge shaft 16 is forced to rotate by the cam shaft 20. This in turn rotates the lift arm 8 (see FIG. 10) then by retracting the paper stack a small distance from the picker roller 6. As the cam need only retract paper a very small distance from the surface of the picker roller in order to prevent it from drawing more sheets from the stack, the power load on the cam drive motor 62 is relatively low. Furthermore, the distance that the stack retracts from the thicker roller will always remain uniform regardless of the grade of paper inserted in paper feed tray. This improves the versatility of the overall feed mechanism.

The invention has been described here by way of example only. Still workers in this field will readily recognize many variations and modifications, which do not depart from the spirit and scope of the broad invented concept.

The invention claimed is:

1. A sheet feed mechanism comprising:

a chassis for supporting a stack of sheets;

a top sheet engaging member for engaging a top most sheet of the stack and moving the sheet relative to the remainder of the stack;

a stack engaging structure for engaging the stack and biasing the top most sheet against the top sheet engaging member, the stack engaging structure being hinged to the chassis at a hinge axis, the stack engaging structure having a friction surface extending therefrom in a direction parallel to a locus of the stack engaging structure about the hinge axis;

a lock mechanism mounted to the chassis, the lock mechanism having a lock arm attached to the hinge axis, and further having a biased contact foot for engaging the friction surface to retard a movement of the stack engaging structure about the hinge axis; and, an actuator for engaging and disengaging the contact foot from the friction surface.

2. A sheet feed mechanism according to claim 1 wherein the stack engaging structure has a resilient member to lift the stack such the top most sheet of the stack is biased against the top sheet engaging member, the biasing force of the resilient member decreases as it elevates the stack, such that as the thickness and weight of the stack decreases, the biasing force likewise decreases and the top-most sheet is biased against the top sheet engaging member with substantially uniform force.

3. A sheet feed mechanism according to claim 1 wherein the actuator is a rotating cam.

4. A sheet feed mechanism according to claim 1 wherein the top sheet engaging member is a rubberized picker roller that rotates to draw the top-most sheet from the stack.

5. A sheet feed mechanism according to claim 3, wherein the lock mechanism has a first class lever pivoted to the lock arm, the contact foot being on one side of the lever and the other side of the lever being configured for engagement with the cam in order to lift the contact foot from the friction surface.

6. A sheet feed mechanism according to claim 5, wherein the chassis further comprises a stop formation formed proximate the cam, and the lock mechanism has a bearing structure fixedly mounted to the lock arm, the bearing structure having a bearing surface for abutting the stop formation, and the lock mechanism also having a resilient member between the bearing structure and the lever opposite the contact foot for biasing the contact foot into engagement with the friction surface.

7. A sheet feed mechanism according to claim 6 wherein the first class lever is generally U-shaped with first and second side arms separated by a cross piece, and the cam being positioned between the first and second side arms for engagement each alternatively, wherein the first side arm forms the lever arm that actuates the contact foot to disengage the friction surface, and the second arm provides the bearing surface against which the cam acts to push the lock arm and the stack engaging structure such that the stack retracts from the top-most sheet engaging member.

8. A sheet feed mechanism according to claim 7 wherein a point of pivot of the first class lever is positioned near the first side arm end of the cross piece, the contact foot is positioned near the second side arm end of the cross piece, and the cam rotates such that any friction between the cam and the second side arm serves to urge the contact foot into engagement with the friction surface.

9. A sheet feed mechanism according to claim 1 wherein the friction surface is an arcuate section having a centre of curvature on the hinge axis and fixed for rotation therewith.

10. A sheet feed mechanism according to claim 9, wherein the stack engaging structure is biased to lift the stack by a coil spring coiled around a shaft.

* * * * *